US006981592B2

(12) United States Patent
Siegel

(10) Patent No.: US 6,981,592 B2
(45) Date of Patent: Jan. 3, 2006

(54) PRODUCT PACKAGING MATERIAL FOR INDIVIDUAL TEMPORARY STORAGE OF PHARMACEUTICAL PRODUCTS

(75) Inventor: Todd Siegel, Clearwater, FL (US)

(73) Assignee: Medical Technologies Systems, Inc., Clearwater, FL (US)

( * ) Notice: Subject to any disclaimer, the term of this patent is extended or adjusted under 35 U.S.C. 154(b) by 256 days.

(21) Appl. No.: 10/269,462

(22) Filed: Oct. 11, 2002

(65) Prior Publication Data

US 2004/0069674 A1 Apr. 15, 2004

(51) Int. Cl.
*B65D 83/04* (2006.01)

(52) U.S. Cl. ..... 206/538; 206/484

(58) Field of Classification Search ..... None
See application file for complete search history.

(56) References Cited

U.S. PATENT DOCUMENTS

| | | | | |
|---|---|---|---|---|
| 3,195,770 | A * | 7/1965 | Robertson | 220/23.6 |
| 3,627,122 | A * | 12/1971 | Garbe, Jr. | 206/571 |
| 3,687,350 | A * | 8/1972 | Warburton | 206/521.1 |
| 3,921,804 | A | 11/1975 | Tester | |
| 4,132,344 | A * | 1/1979 | Jewell | 229/406 |
| 4,429,792 | A * | 2/1984 | Machbitz | 206/531 |
| 4,844,246 | A * | 7/1989 | Harrison et al. | 206/223 |
| 4,998,623 | A | 3/1991 | Doull | |
| 5,011,018 | A * | 4/1991 | Keffeler | 206/532 |
| 5,014,851 | A * | 5/1991 | Wick | 206/539 |
| 5,323,907 | A * | 6/1994 | Kalvelage | 206/531 |
| 5,482,159 | A * | 1/1996 | Roraback et al. | 206/223 |
| 5,489,025 | A * | 2/1996 | Romick | 206/531 |
| 5,735,406 | A * | 4/1998 | Keffeler | 206/535 |
| D411,445 | S * | 6/1999 | Anderson | D9/341 |
| 5,927,500 | A * | 7/1999 | Godfrey et al. | 206/531 |
| 5,947,321 | A * | 9/1999 | Vadney | 220/367.1 |
| 6,023,916 | A * | 2/2000 | Bouthiette | 53/471 |
| 6,053,346 | A * | 4/2000 | Niles et al. | 220/62 |
| 6,338,408 | B1 | 1/2002 | Anderson | |
| 6,681,935 | B1 * | 1/2004 | Lewis | 206/534 |

FOREIGN PATENT DOCUMENTS

| | | |
|---|---|---|
| WO | WO 97/20754 A1 | 6/1997 |
| WO | WO 2003/089333 A1 | 10/2003 |

* cited by examiner

*Primary Examiner*—Shian T. Luong
(74) *Attorney, Agent, or Firm*—Robert J. Depke; Trexler, Bushnell, Giangiorgi, Blackstone & Marr, Ltd.

(57) ABSTRACT

An improved temporary pharmaceutical product packaging solution provides users with multiple individual cavities that may be filled with multiple individual doses of various pharmaceuticals and subsequently sealed by the user for future consumption of the pharmaceuticals. In a preferred exemplary embodiment, the user is able to simultaneously seal a plurality of individual cavities with a sheet of cover material after the individual cavities have been filled with the desired pharmaceuticals. In a preferred exemplary embodiment of the cover material is reverse printed with dosing information for an individual.

1 Claim, 4 Drawing Sheets

PRODUCT PACKAGING MATERIAL FOR INDIVIDUAL TEMPORARY STORAGE OF PHARMACEUTICAL PRODUCTS

BACKGROUND OF THE INVENTION

1. Field of the Invention

The present invention relates generally to the field of pharmaceutical product packaging materials. More specifically, the present invention is directed to a product packaging solution for packaging a plurality of individual temporary storage packages for solid pharmaceutical products.

2. Description of the Related Art

There are currently a wide variety of pharmaceutical product packaging solutions available for the temporary storage of pharmaceutical products. This is due to the fact that there are many people under the care of physicians who are required to take numerous prescription drug products on any given day and in some instances individuals are required to take multiple doses of medication throughout the day. In most instances, an individual receives one more prescriptions from a doctor and a pharmacy provides a supply of the required pharmaceuticals in a single container. Thus, when an individual is required to take numerous pharmaceutical products throughout a given day, the individual is required to accesses each of the individual storage containers for the various pharmaceutical products.

While this is not terribly inconvenient when an individual is taking a single medication, it does become problematic when the person is required to take multiple medications in a single day and is particular troublesome when the person is required to take multiple medications at various times throughout the day. Especially with the significant increase in the aging population, it has become ever increasingly common for individuals to be required to take multiple doses of multiple medications at various times throughout the day. It is not uncommon for individuals to be required to take five or more different products on any given time during the day.

These increasingly common regimens of pharmaceutical product doses can become difficult for users to ensure that the appropriate medications are taken at the correct times. Without assistance, the requirement to take these multiple medications at various times throughout a given day can be confusing for individuals. An individual on such a regimen of pharmaceuticals can easily forget whether a particular required dosage was taken at a given time. As a result, it is not uncommon for patients to receive either more or less than the required or specified doses of their medicines.

Another problem arises when an individual who has received multiple prescriptions for pharmaceuticals is away from home for a given period time. If such an individual will be gone for a number of days, the person must either take all of the medications for all of the various prescriptions along or the user is required to selectively remove the required doses for a given period of time from the original packaging. This can be more than a minor inconvenience especially when the travel is unexpected or otherwise on short notice.

Although there are number of solutions for temporarily storing the pharmaceutical products that are currently available, none provides users with a very convenient disposable temporary storage device for multiple prescriptions. Accordingly, there remains a need in the field for improved temporary pharmaceutical product package storage devices that provide users with the ability to selectively temporarily store doses of individual prescriptions in a convenient disposable package. Other objects and advantages of the present invention will be apparent in light of the following Summary and detailed description of presently preferred embodiments.

SUMMARY OF THE INVENTION

The present invention is directed to temporary pharmaceutical product package storage devices that enable users to selectively prepare individual disposable dosage packets with one or more various pharmaceuticals to be consumed on or within a specified period time. The packaging solutions of the present invention specifically provide users with the ability to store all of the required doses of various medications in disposable containers. Advantageously, users can utilize the packaging solutions of the present invention in order to pre-fill individual disposable dosage packets with the required pharmaceuticals for a given day, or portion of the day.

In one preferred exemplary embodiment of the present invention, users are able to selectively prepare individual disposable dosage packets with all of the dosing requirements of one or more pharmaceuticals for a particular week or other period time. This enables a user to travel away from home without taking all of the medication containers for all of the prescription pharmaceuticals and/or vitamins that the patient is taking. Desirably, users are able to selectively fill packages and use the pre-filled disposable packages at some later point in time.

In accordance with the preferred exemplary embodiment of the present invention, the pharmaceutical product packaging solution of the present invention provides a thick member that in the preferred exemplary embodiment has a depth that is preferably greater than the depth of the disposable package members. The thick member has a plurality of holes arranged in a predetermined fashion to receive a corresponding plurality of package member front or top portions that are comprised of preferably clear molded plastic members that are formed from sheets of plastic material. In accordance with the preferred exemplary embodiment, preferably a plurality of sheets of the molded clear plastic material, each of the sheets having a plurality individual dosage cavities formed therein, are stacked in the thick member such that the cavity portions fall within the corresponding holes of the thick member. The thick-member is used in order to ensure that the individually formed cavities are not damaged during shipping or other handling of the packaging material of the present invention. Additionally, the thick portion of the overall packaging solution acts as a die to provide peripheral support around the individual package member cavities. Thus, it enables a user to readily fill the individual cavities with the desired solid pharmaceuticals and/or vitamins and also provides a relatively sturdy perimeter for sealing the individual cavities with a cover sheet.

The overall packaging solution of the present invention also preferably includes backing material that may be used for sealing the individual dosage cavities. In that regard, a plurality of sheets of materials having at least a portion of which that contains adhesive or temporarily coated adhesive so that the sheets of material may be utilized for sealing the individual dosage packets. With the instant pharmaceutical product packaging solution of the present invention, users are able to selectively fill the individual dosage packets and subsequently seal them for later use.

In accordance with the preferred exemplary embodiment of present invention, sheets of the sealing portions are located adjacent to the sheets of cavity members. As a result, users are able to remove the backing covering the portions of the sheets containing adhesive and simply fold the sheets over to cover and seal the individual dosage packets. In a further preferred exemplary embodiment, the sheets of cover material are reverse printed with dosing information for the pharmaceuticals that have been inserted by the user. As a result, by folding over the cover material to seal the individual dosage packets, the clear plastic sheet from which the individual cavities are formed allows the user to see the printed material indicating the dosing information. Users may choose between daily indications or multiple daily indications for dosing requirements. For example, this information may include consumption day information and/or identification of the time at which a dose should be administered.

DETAILED DESCRIPTION OF THE PRESENTLY PREFERRED EMBODIMENTS

Figure 1:
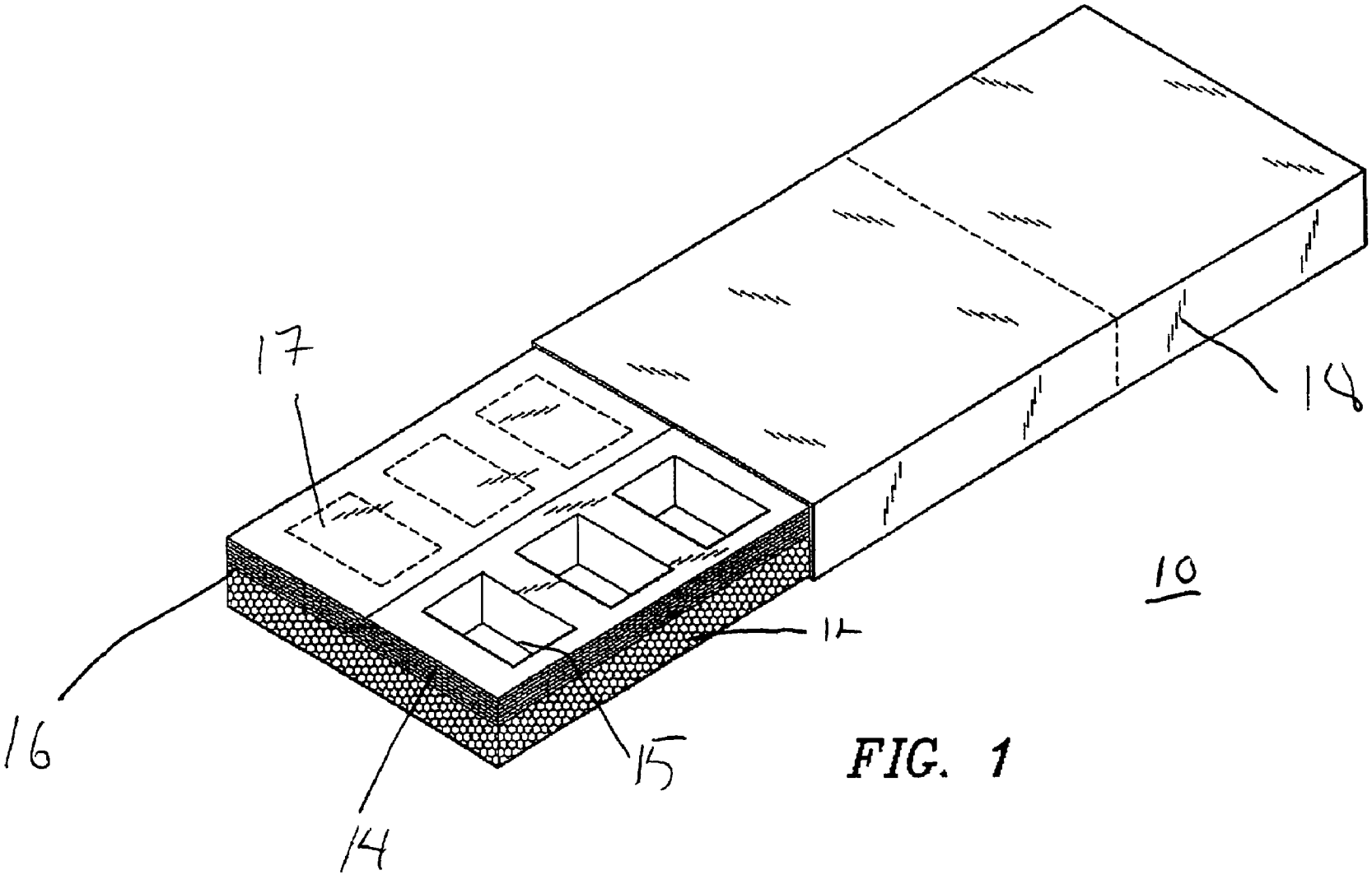
FIG. 1 illustrates a first preferred exemplary embodiment of the present invention.

FIG. 1 illustrates a first exemplary embodiment of the present invention which is shown generally at 10. In accordance with the first preferred exemplary embodiment, a thick support member 12 is provided for receiving a plurality of sheets of dosage packets forming members. The thick support member 12 is preferably formed of foam or plastic and ensures that the pre-formed cavity members are not crushed or otherwise damaged during shipping or other processing of the packaging device of the present invention. Furthermore, as noted above, this thick member acts as a die and provides support around the perimeter of the individual cavities to aid users in sealing the individual cavities with the adhesive coated covering material. This thick member is preferably formed from lightweight material in order to ensure that the overall packaging product is not unnecessarily heavy.

As shown in FIG. 1, a plurality of sheets of material 14 having cavities 15 formed therein are located within corresponding holes in the thick support member 12. In accordance with a preferred exemplary embodiment, the sheets 14 are formed of clear plastic and the cavities 15 are molded therein preferably by stamping the cavities into the heated clear plastic sheets as is known in the art. In the preferred exemplary embodiment, sheets of cover members 16 are located adjacent to be sheets of preferably clear plastic 14 having the cavities 15 formed therein. In the preferred exemplary embodiment, the cover members 16 each include scoring or perforations that define a perimeter 17 which enables a user to easily remove the central portion of the cover members 16 in order to gain access to the cavities 15 when the cavities have been sealed with the cover members 16.

Those skilled in the art will appreciate that clear plastic need not be used for the formation of the sheets 14 having the cavity members 15 formed therein. Virtually any material will suffice. All that is necessary is that there be sufficient border around each of the cavities 15 to allow a user to seal the cavity member. Multiple sheets of packaging material along with the thick support member 12 are located within the product cover member 18. The product cover member 18 is also preferably formed of plastic and is preferably clear in order to allow consumers to readily identify the product contained within the package 18.

Figure 2:
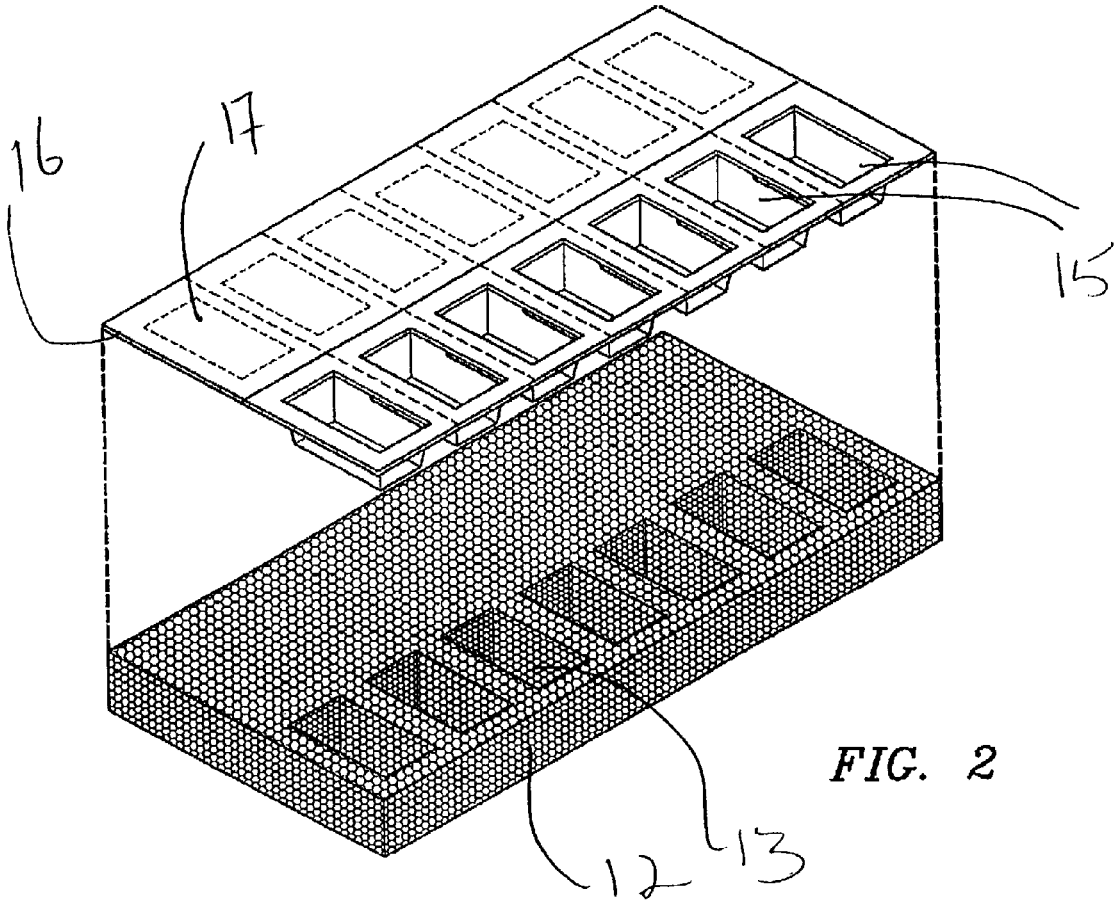
FIG. 2 is an illustration that shows separation of the cover material and cavity members from the thick support member in accordance with a preferred exemplary embodiment of the present invention.

FIG. 2 illustrates the temporary pharmaceutical product packaging solution of the present invention wherein the sheets of material 14 having cavities formed therein 15 and the corresponding cover members 16 are separated from the thick support member 12. This view illustrates the holes 13 formed within the thick member 12 for receiving individual cavity members 15 formed in the sheets of material 14. As noted above, this relationship ensures that the thick support member 12 protects the cavity members 15 from damage during processing and shipping. As noted, it may also act as a die in order to provide support around the perimeter of each individual product package cavity when a user seals the cavity.

Figure 3:
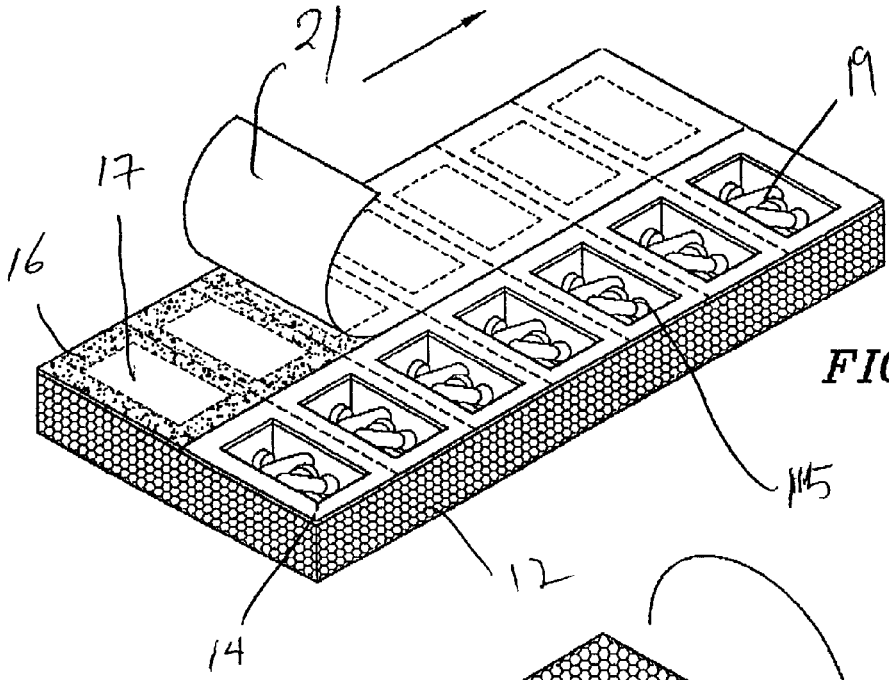
FIG. 3 illustrates a step in the process of filling and sealing individual cavity members.

FIG. 3 illustrates a step in the process of filling and sealing individual temporary storage members that are useful for storing multiple doses of multiple pharmaceutical products. Those skilled in the art will appreciate that the packaging solution of the present invention may also be useful in other areas where temporary disposable packaging is required.

As shown in FIG. 3, one sheet of material 14 having cavities 15 formed therein is located within the thick support member 12 such that the cavities 15 are located within corresponding holes 13 in the packaging solution of the present invention. As shown in FIG. 3, a user is able to locate a plurality of various pharmaceutical products 19 within each of the cavities 15. FIG. 3 specifically illustrates removal of backing material 21 from the cover members 16. As shown in this illustration of a preferred exemplary embodiment, the backing material 21 protects an adhesive border located on the cover sheet 16. The adhesive border corresponds to a perimeter of the sheets 14 surrounding each of the cavities 15 so that the cover members 16 may be secured to the sheets 14 such that each of the individual cavities 15 have been preferably sealed.

Figure 4:
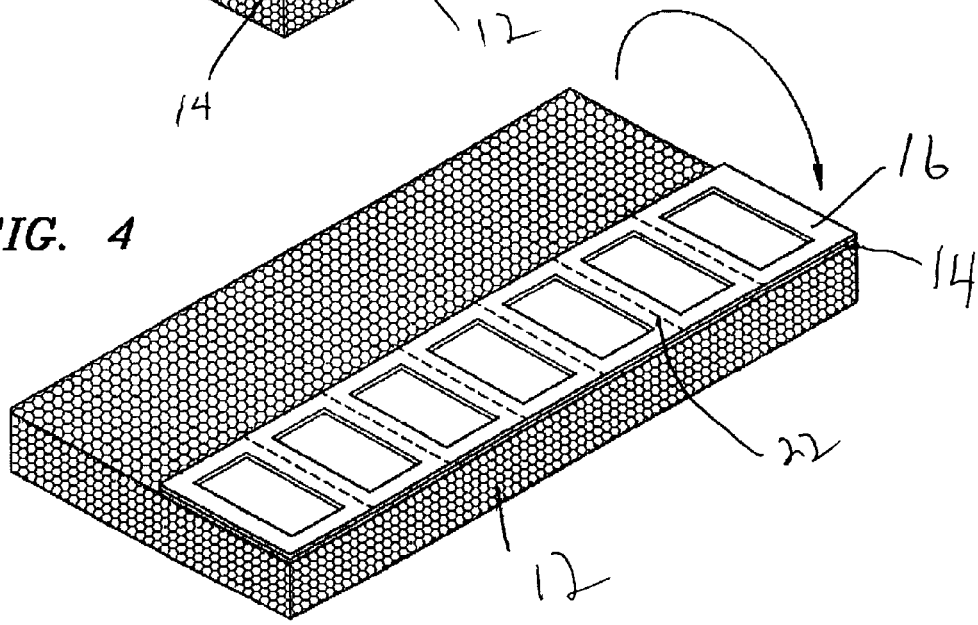
FIG. 4 illustrates a further step in the process of filling and sealing individual cavity members.

FIG. 4 illustrates a further step in the sealing process wherein the sheets of cover members 16 have been folded over the sheets 14 having the cavities formed therein. This step results in the sealing of the individual cavities Those skilled in the art will appreciate that this is the preferred exemplary embodiment and that other configurations are possible as well. For example, in an alternate exemplary embodiment of the present invention, the sheets 14 having the cavities 15 formed therein are at least substantially coextensive with the thick cover member 12 and there are preferably multiple rows of cavities. In such an alternate embodiment, the cover members 16 are simply stacked on top of the sheets 14 and a user simply selectively applies a single sheet of cover members 16 at a time for sealing the cavities 15 in an upper sheet. Specifically, it is not necessary for the cover members 16 to be located adjacent to the sheets 14 so that they may be folded over thereon. Folding is only described with respect to the preferred exemplary embodiment.

Figure 5:
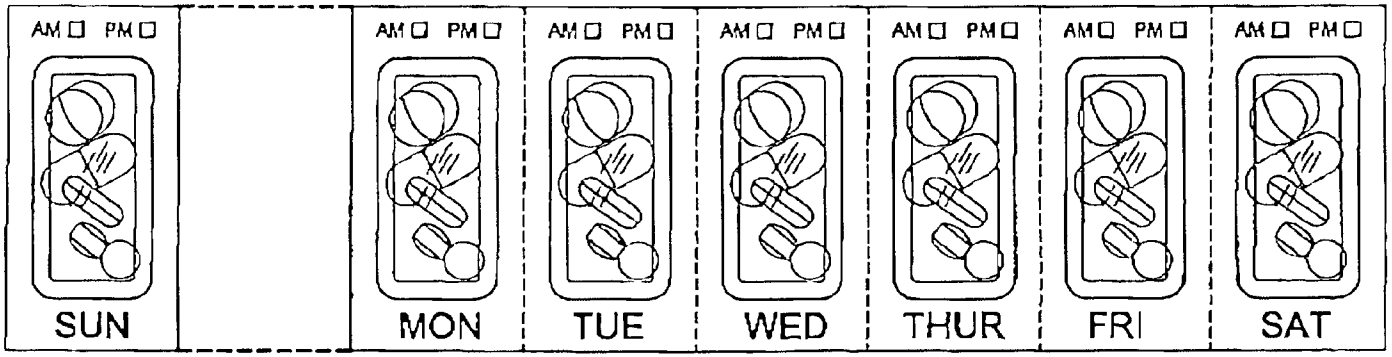
FIG. 5 illustrates a plurality of filled and sealed cavity members in accordance with a preferred exemplary embodiment of the present invention.

FIG. 5 is a top plan view which illustrates a plurality of sealed cavities 15 containing multiple pharmaceuticals 19. The product packaging solution of the present invention provides users with a simple device for temporarily storing doses of multiple pharmaceuticals for later consumption. As shown in FIG. 5, the backing material 6 may be reverse printed with dosing indications for a user. Alternately, the printing can be printed on either side of the cover member or even the cavity in order to provide dosing indications for users. As noted, this may include identification of a particular day of intended consumption and/or the specific times at which the medication should be consumed. This provides a simple mechanism for a user to identify the appropriate time for taking one of the packages of medications. FIG. 5 also illustrates perforations or scoring 22 between individual dosage packets. This is a further convenience for a user so that only a limited number of packages may be removed in order to provide convenient access for a user.

Figure 6:
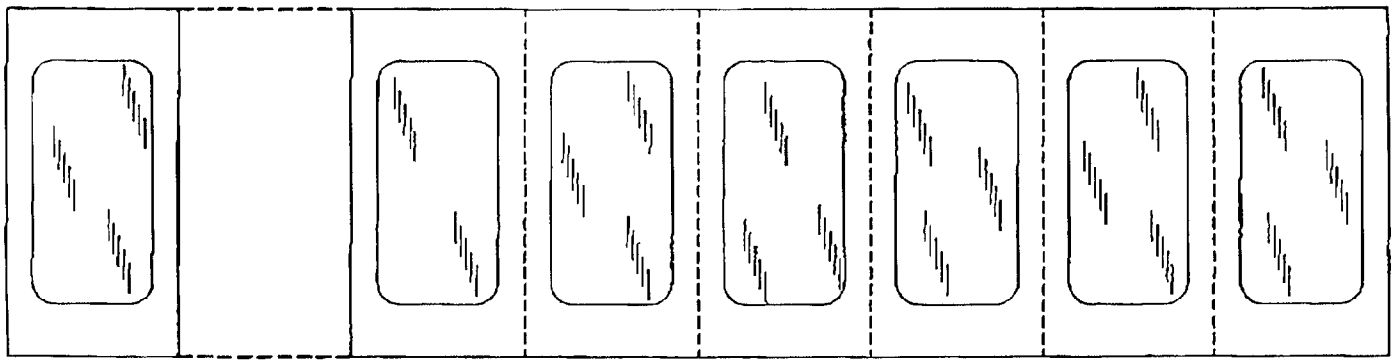
FIG. 6 illustrates a plurality of clear plastic cover members with cavities formed therein in accordance with a preferred exemplary embodiment of the present invention.

FIG. 6 is a top plan view that illustrates one of the sheets 14 having the cavities 15 formed therein. As shown in FIG. 6, the sheets 14 also preferably include scoring or perforations between cavities 15 so that the user may readily separate individual dosage packets. As noted above, in the preferred exemplary embodiment, the sheets 14 are formed from a clear plastic material and the cavities 15 are simply molded therein as is known in the art it is contemplated that other materials may be useful as well.

The present invention has been described with respect to the preferred exemplary embodiment of the present invention. It is contemplated that various substitutions and modifications may be made to the specific devices and structures disclosed herein by will nonetheless fall within the scope of the present invention as described in the appended claims.

I claim:

1. Packaging for a plurality of temporary pharmaceutical product packages comprising:

a support member;

a plurality of sheets of material, each sheet having a plurality of cavities formed therein, the sheets of material are stacked such that the cavities of each sheet are in registration with adjacent sheets in the stack and wherein the cavities are located within holes formed in the support member; and a plurality of sheets of cover material stacked adjacent to the sheets of material having cavities formed therein, wherein each sheet of cover material is secured to a corresponding sheet of material having cavities formed therein such that the sheet of cover material folds over to seal a plurality of cavities; and further wherein each sheet of cover material is further comprised of an adhesive layer formed thereon which is selectively positioned such that when the sheet of cover material is folded over the cavities, the adhesive surrounds each cavity.

* * * * *